United States Patent [19]

Pilkington et al.

[11] 4,030,146

[45] June 21, 1977

[54] TOILET SEAT LIFTING APPARATUS INCLUDING A RESILIENT BOWED MEMBER FOR PREVENTING THE SEAT FROM SLAMMING

[76] Inventors: Ted S. Pilkington, 1050 Crestview Drive F-41, Mountain View, Calif. 94040; Henry H. Castle, 11123 Beacon Ave., South, Seattle, Wash. 98178

[22] Filed: Dec. 29, 1975

[21] Appl. No.: 645,248

[52] U.S. Cl. ..... 4/251

[51] Int. Cl.[2] ..... A47K 3/10

[58] Field of Search ..... 4/251, 1

[56] References Cited

UNITED STATES PATENTS

| | | | |
|---|---|---|---|
| 1,509,242 | 9/1924 | Kuno | 4/251 |
| 1,863,295 | 6/1932 | Bukovitz | 4/251 |
| 1,999,070 | 4/1935 | Svedelius | 4/251 |
| 2,278,244 | 3/1942 | Smithwick | 267/160 |
| 3,055,016 | 9/1962 | Kemp | 4/251 |
| 3,408,061 | 10/1968 | Meyer | 267/160 |

*Primary Examiner*—Richard E. Aegerter
*Assistant Examiner*—John W. Shepperd
*Attorney, Agent, or Firm*—Boone, Schatzel, Hamrick & Knudsen

[57] ABSTRACT

A toilet seat lifting apparatus comprising a base which is bolted to the base of a toilet, a foot pedal pivotally mounted to the base, a bowed member formed of a resilient material and interconnecting adjacent ends of the base and the foot pedal, a plate secured to the toilet seat and an arm connecting the foot pedal and the toilet seat, the bowed member being movable between a lowered position and a raised position when the foot pedal is depressed, and slightly biasing the toilet seat away from the toilet bowl so as to prevent the seat from slamming as the foot pedal is released. In the preferred embodiment the apparatus is formed from polypropylene material.

3 Claims, 3 Drawing Figures

TOILET SEAT LIFTING APPARATUS INCLUDING A RESILIENT BOWED MEMBER FOR PREVENTING THE SEAT FROM SLAMMING

BACKGROUND OF THE INVENTION

1. Field of the Invention

The present invention relates generally to a foot-operated toilet seat lifting device, and more particularly to such devices that employ a bowed member formed of a resilient material which is movable when a foot pedal is depressed and which serves to prevent the seat from slamming when the pedal is released.

2. Description of the Prior Art

It is generally well known that many persons find it objectionable to handle any part of a toilet, particularly a public toilet that may be used by all types of persons with varied habits of cleanliness. In view of the fact that the toilet seat should be raised when a male is in the act of urinating, devices are available for lifting the toilet seat when a pedal is depressed.

One type of such device includes a base, a foot pedal lever attached by an arm to a toilet seat, and an air cylinder-piston rod assembly connected between the base and the arm that serves to damp the return force to the seat when the pedal is released. A disadvantage of a device of this type is that it includes parts which are subject to failure after relatively short amounts of time, especially since such a device is utilized in public toilets and hence subject to vandalism.

Examples of prior art toilet seat lifting devices can be found in U.S. Pat. No. 428,001, J. A. Kaley, "Privy Seat"; U.S. Pat. No. 1,501,177, B. Ozwirk, "Basin Cover Appliance"; U.S. Pat. No. 1,792,811, E. Bustin, "Seat and Cover Lifter for Toilets"; U.S. Pat. No. 1,856,159, T. Gills et al, "Water Closet Seat"; U.S. Pat. No. 1,999,070, L. D. Svedelius, "Toilet Seat Lifter"; U.S. Pat. No. 3,140,113, G. S. Williams, "Transfer Finger Assembly"; U.S. Pat. No. 3,345,650, O. E. Waters, "Toilet Seat Sanitary Lifting Mechanism"; and U.S. Pat. No. 3,504,385, M. Field, "Toilet Seat Lifter."

SUMMARY OF THE PRESENT INVENTION

It is therefore an object of the present invention to provide a toilet seat lifting apparatus that is rugged, relatively simple in construction, has a relatively long life time and is inexpensively fabricated from strong, light-weight materials.

Briefly, a preferred embodiment of the present invention includes a base which is capable of being secured to the toilet base and which includes an upright member, a foot pedal including a central portion pivotally mounted to the upright member, a foot-receiving portion proximate a a first end of the pedal which is adapted to be depressed by the foot of a user, and a connecting portion proximate an opposed second end of the pedal, an elongated bowed member having one end affixed to the base and the other end connected to the connecting portion, the bowed member being formed of a resilient material and hingedly movable between a lowered condition and a raised condition, the resilient material serving to bias the bowed member slightly toward the raised condition, and an arm having one end connected to the connecting portion and another end connected to a plate which secures the device to the toilet seat, whereby when the foot-receiving portion is depressed the bowed member moves from the lowered condition to the raised condition causing the arm and hence the toilet seat to raise and whereby when the foot-receiving portion is released the bowed member damps the force associated with the lowering of the arm so as to prevent the seat from slamming against the toilet.

Some of the advantages of the present invention are that it is rugged, relatively simple structurally, inexpensive to produce, and has a relatively long life expectancy.

Other objects and advantages of the present invention will be apparent to those skilled in the art after having read the following detailed description of the preferred embodiment which is illustrated in the several figures of the drawing.

IN THE DRAWING

DETAILED DESCRIPTION OF THE PREFERRED EMBODIMENT

Figure 1:
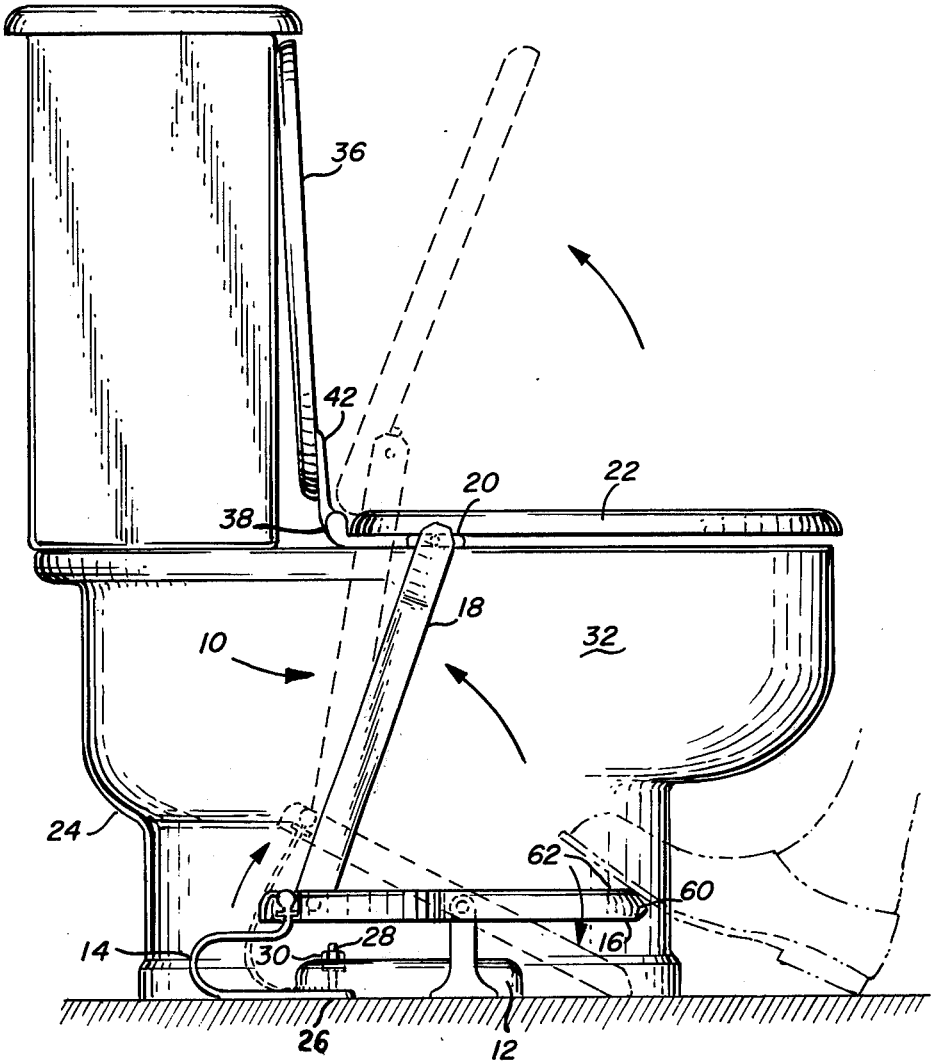
FIG. 1 is a side elevational view of the toilet seat lifting apparatus in accordance with the present invention with the components illustrated in dashed lines when the seat is in the raised condition.

In FIG. 1 of the drawing, a side elevational view of the apparatus 10 for lifting a toilet seat in accordance with the present invention is illustrated. The apparatus 10 includes a base 12, a bowed member 14, a pedal 16, an arm 18 connected to an end of the pedal and a plate 20 securing the arm 18 to a seat 22 of a toilet 24.

As shown, the toilet 24 is of a conventional type and includes a base 26 having apertures therethrough for receiving threaded studs 28 protruding upwardly through the floor of the bathroom, nuts 30 for securing the base 26 to the floor, a bowl 32, the toilet seat 22 and a cover 36. The seat 22 has a generally oval shape and includes a pair of brackets 38. The brackets 38 are mounted to a horizontal shaft (not shown) that is rotatably secured to posts extending from the top of the bowl 32 so as to enable the seat 22 to be pivotable between a closed position and an open position (shown in dashed lines). In a similar manner, the cover 36 includes a pair of brackets 42 which serve to pivotally mount the cover relative to the common shaft.

Figure 2:
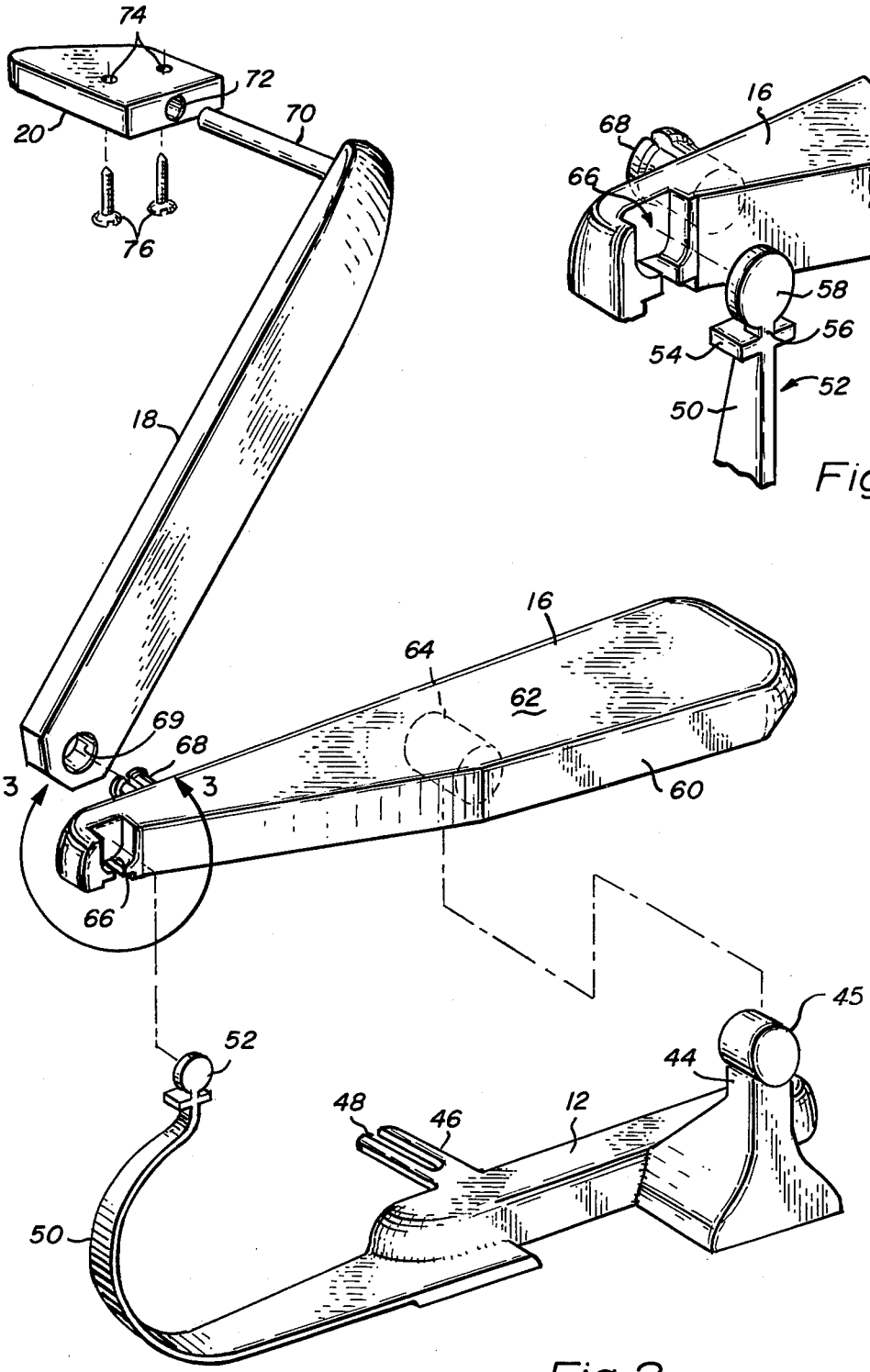
FIG. 2 is an exploded perspective view of the apparatus of FIG. 1.

Referring also to FIG. 2, which illustrates the parts of the apparatus 10 in an exploded perspective view, the base 12 includes an upright member 44, an opposed bifurcated tongue 46 having a slot 48, and an elongated member 50. The upright member 44 has an upper surface that is arcuate and resembles a convex semicircle in side view. The upper surface includes lower portions 45 that are flared downwardly (see FIG. 2). As will be subsequently described the upright member 44 serves to pivotally support the pedal 16. The tongue 46 extends outwardly from the upper surface of the base 12 and is formed to enable the base 12 to be positioned in a covering relationship over the toilet base 26 with the stud 28 aligned with and protruding through the slot 48.

The elongated member 50 is tapered in plan view and extends tangently rearwardly from the rear portion of the base 12 proximate the bottom surface thereof. Its distal end 52 includes a flared portion 54, a neck portion 56 and a thin cylindrical latch portion 58 (see FIG.

3). The end 52 serves to latch the member 50 to the pedal 16 when the member 50 is formed into a bowed shape as will be subsequently described. In accordance with the present invention, the member 50 is formed from a deformable, resilient material. In the preferred embodiment, the member 50 is integral with the base 12 and is formed by polypropylene material.

Figure 3:
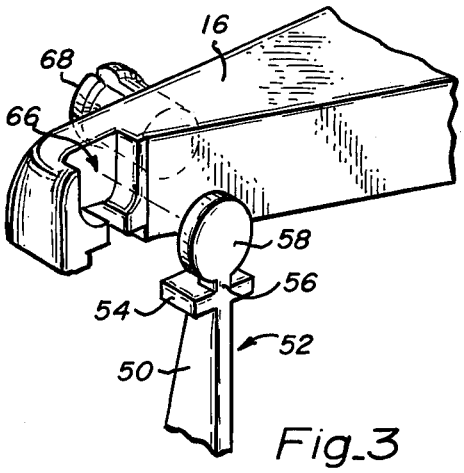
FIG. 3 is an enlarged perspective view taken along the lines 3—3 of FIG. 2 illustrating the connection between the bowed member and the foot pedal.

The pedal 16 includes an end 60 having a top foot-receiving surface 62, a central portion having a groove 64 therein, and a tapered rear portion having a recess 66 formed in a side surface and a stud 68 protruding from an opposed side surface. The groove 64 serves to receive the upper portion of the upright member 44 in such a manner that the flared portions 45 are captured within the groove 64. After the member 44 is inserted into the groove, the curved arcuate shape of its upper portion and conforming shape of the groove enables the pedal to be pivotal relative to the upright member. With reference to FIG. 3, the recess 66 includes a lower opening facing the bottom surface of the pedal, an uppe- opening facing the top surface of the pedal, and a channel interconnecting the lower and the upper openings. The channel extends a distance slightly less than the dimension corresponding to the neck 56 such that the lower opening, the channel, and the upper opening of the recess 66 serve to receive the flared portion 54, the neck portion 56 and the latch portion 58, respectively, of the end 52. Because the flared and latch portions 58 are enlarged relative to the neck 56, end 52 is secured in a locking manner in the recess 66. Due to its lateral dimension, the member 50 is relatively stiff in a transverse direction and thus is prevented from inadvertently skewing during operation. This assures that the end 52 does not become separated from the pedal 16.

The arm 18 is an elongated element having an aperture 69 in one of its side surfaces proximate an end and a thin cylindrical rod 70 protruding from an opposed side surface proximate its other end. The aperture 69 serves to receive the stud 68 in an interference fit while allowing the arm 18 to be rotatable about the stud.

The plate 20 includes a flat top surface, a hole 72 for receiving the rod 70 in an interference fit and apertures 74 for receiving screws 76. The screws 76 serve to secure the plate 20 to the underside of the toilet seat 22.

In assembling the apparatus 10, the base 12 is placed over the toilet base 26 with a stud 28 protruding through the slot 48 and secured thereto with the nut 30. The upper portion of the upright member 44 is inserted into the groove 64 so as to pivotally mount the pedal 16 to the upright member 44. The member 50 is bowed or deformed as shown in FIG. 2 with parallel and substantially horizontal top and bottom portions interconnected by a bight portion so as to resemble a generally C-shape in side view. Next the member 50 is locked to the pedal 16 by inserting the end 52 into the recess 66. When the member 50 is thus deformed, due to its resilient characteristics it serves as the bowed member 14 which is movable between a normal lowered condition and a raised condition (shown in dashed lines in FIG. 1) and which serves to bias the rear portion of the pedal 16 in an upward direction. The stud 68 is inserted into the aperture 69, thus mounting the arm 18 to the pedal, and the rod 70 is inserted into the hole 72, thus securing the plate 20 to the arm. Next, the screws 78 are inserted through the apertures 74 and tightened, securing the apparatus 10 to the toilet seat 22.

In use, when it is desired to raise the toilet seat 34, the user places his foot on the surface 62, which causes the pedal 16 to depress. In turn the bowed member 14 pivots and moves upwardly, which raises the arm 18 and hence causes the toilet seat 22 to pivot open. When the foot is removed, the seat 22 falls due to the force of gravity. However, due to the normal upward bias force exerted by the bowed member 14, the seat is prevented from slamming into the top of the toilet bowl 32.

In the preferred embodiment, the base, the elongated member, the pedal, the arm, and the plate are formed with a plastic injection molding process. Such injection molding processes are well known in the art, and it is not claimed that the process forms a part of the present invention.

From the above, it can be seen that an improved toilet seat lifting apparatus has been described which fulfills all of the objects and advantages set forth above.

While the invention has been particularly shown and described with reference to a certain preferred embodiment, it will be understood by those skilled in the art that various alterations and modifications in form and detail may be made therein. Accordingly, it is intended that the following claims cover all such alterations and modifications as fall within the true spirit and scope of the invention.

What is claimed is:

1. A toilet seat lifting apparatus for attachment to a toilet having a bowl with a lower flange and a seat, said apparatus comprising:

a base having means adapted to be secured to a lower flange of a toilet bowl and including an upright portion and a flexible elongated portion, said upright portion having a top surface with an arcuate shape, and said flexible elongated portion extending rearwardly of said base and terminating in a distal end that is formed into a latch;

a foot pedal having first and second ends and including a central portion, a foot-receiving portion proximate said first end which is adapted to be depressed by the foot of a user, and a connecting portion proximate said second end having means forming a recess for receiving and retaining said latch, said central portion having a groove therein which is bounded by an upper surface having an arcuate shape that generally conforms to said top surface, said groove serving to receive the means forming said top surface such that said central portion is pivotally mounted to said upright portion, said latch engaging said means forming a recess so as to form said flexible elongated portion into a bowed C-shape with said latch extending generally upwardly, said flexible elongated portion serving to urge said second end in an upward direction and to pivot said foot pedal about said upright portion;

an arm having a third end attached to said connecting portion and having a fourth end; and means connected to said fourth end and adapted for securing said arm to a toilet seat, whereby when said foot-receiving portion is depressed said toilet seat is caused to raise, and when said foot-receiving portion is released said flexible elongated portion damps the force associated with the lowering of said seat so as to prevent said seat from slamming against the toilet bowl.

2. A toilet seat lifting apparatus for attachment to a toilet as recited in claim 1, wherein the lower flange of the toilet bowl includes a stud protruding upwardly therefrom, and wherein said base includes a bifurcated tongue forming a slot for receiving the stud, said tongue serving to align said base relative to the lower flange.

3. A toilet seat lifting apparatus for attachment to a toilet as recited in claim 1 wherein said means forming a recess includes a side surface with a recess having enlarged end portions separated by a narrow channel portion, and wherein said latch includes a flared portion, a neck portion and a latch portion configured to be received and retained within said end portion, said narrow channel portion and said end portion, respectively.

* * * * *